US005109807A

United States Patent [19]

Sarkisian et al.

[11] Patent Number: 5,109,807

[45] Date of Patent: May 5, 1992

[54] HIGH OUTPUT MINI HYDRONIC HEATER

[75] Inventors: Paul Sarkisian, Watertown; Fred Becker, Reading, both of Mass.

[73] Assignee: Gas Research Institute, Chicago, Ill.

[21] Appl. No.: 523,853

[22] Filed: May 15, 1990

[51] Int. Cl.[5] ..... F22B 9/00

[52] U.S. Cl. ..... 122/20 B; 237/56; 165/29

[58] Field of Search ..... 237/8 R, 19, 56; 122/20 B; 126/101 B; 165/128, 129, 130, 131

[56] References Cited

U.S. PATENT DOCUMENTS 2,937,625 5/1960 Meyers ..... 122/33
3,171,387 3/1965 Muller ..... 122/33
3,341,122 9/1967 Whittel, Jr. ..... 237/8
3,890,936 6/1975 McInerney et al. ..... 237/8 R X
4,178,907 12/1979 Sweat, Jr. ..... 126/101
4,671,459 6/1987 Stapensen ..... 237/8
4,854,381 8/1989 Mikula ..... 237/55 X

*Primary Examiner*—Henry A. Bennett
*Attorney, Agent, or Firm*—Lorusso & Loud

[57] ABSTRACT

An efficient compact modulating or fixed firing rate hydronic heater is provided. A slotted single piece baffle encloses the heat exchange surface which is a wound finned tube, and improves gas flow contact with the heat exchange surface, thereby increasing the efficiency of heat transfer.

3 Claims, 5 Drawing Sheets

HIGH OUTPUT MINI HYDRONIC HEATER

BACKGROUND OF THE INVENTION

1 Field of the Invention

The present invention relates generally to an improved hydronic heater, and particularly to a modulating hydronic heater of compact size and high efficiency.

2. Prior Art

Central heating systems employing hot water circulating through a network of pipes have been used for many years for room space heating, snow melting, indirect swimming pool heating, and other similar purposes. Such systems are now generically referred to as hydronic heating systems.

Much of the prior art relating to hydronic heaters is concerned with the design or regulation of an integrated heating system such as could be used to heat open space and to supply hot water for domestic use. Thus, U.S. Pat. No. 3,171,387, entitled "Combined Heating and Warm Water Preparing Apparatus" teaches an apparatus for efficiently providing heated water for space heating or domestic use regardless of environmental temperature. U.S. Pat. No. 3,341,122, entitled "Integrated Hydronic Heating System" teaches a similar apparatus. U.S. Pat. No. 4,178,907 entitled "Unified Hot Water and Forced Air Heating System", teaches an apparatus which uses air for space heating while providing hot water for domestic use.

Hydronic heaters of the prior art have typically been large. Attempts to reduce the size of such heaters has led to inefficiency. Hydronic heaters typically have a gas-to-water heat exchange chamber in which hot combustion gases from a combustion chamber flow over tubing containing water to be heated. Because of low gas velocities and associated heat transfer coefficients, large surface areas are required to achieve good heat transfer. To make a more compact unit and still maintain good heat transfer, finned tubing is used to transfer heat from the hot gases to the circulating water.

SUMMARY OF THE INVENTION

In accordance with the improved hydronic heater of the present invention, high heat transfer in the heat exchange chamber of a hydronic heater can be achieved by use of a baffle with metering orifice slots to produce an efficient yet compact hydronic heater. The baffle also helps to insure even flow distribution over the heat exchange surface. The burner section of the heater of the invention includes a pre-mix gas valve and blower with a ceramic tile burner plate, and the ignition system preferably has a silicon carbide ignitor which also acts as a flame sensor. The heat transfer surface is a wound integral finned tube through which water to be heated flows, and is enclosed by a slotted baffle to improve heat transfer and flow distribution. The wound finned tube and baffle produce a compact yet efficient heat exchange area by improving gas flow contact with the heat exchange surface The combustion chamber area itself is bound by the heat exchange surface, refractory material and the ceramic burner tile. The housing and flue of the hydronic heater are made of corrosion resistant metal and the housing has external insulation which is protected by a sheet metal skin.

Accordingly, it is an object of the present invention to provide a hydronic heater of compact size yet high efficiency.

It is another object of the present invention to provide a gas-fired hot water heater with efficient heat exchange through good contact and distribution of combustion gas in the exchange chamber in which water is heated.

These and other objects and advantages of the present invention will become clear from the description of the invention and the drawing below.

DESCRIPTION OF THE PREFERRED EMBODIMENTS

At the outset, the invention is described in irs broadest overall aspects, with a more detailed description following. In its broadest overall aspects, the present invention is a low cost, efficient, hydronic heater in compact size, capable of operation at a fixed firing rate or a modulating firing rate. More particularly, the present invention is a compact heater with improved gas to water heat transfer in its heat exchange chamber. Improved heat transfer is accomplished by an attachment according to which hot combustion gases are in even, well distributed contact with the heat exchange surface of an integral finned spiral tube, through the use of a metered baffle which encloses the tube.

Figure 1:
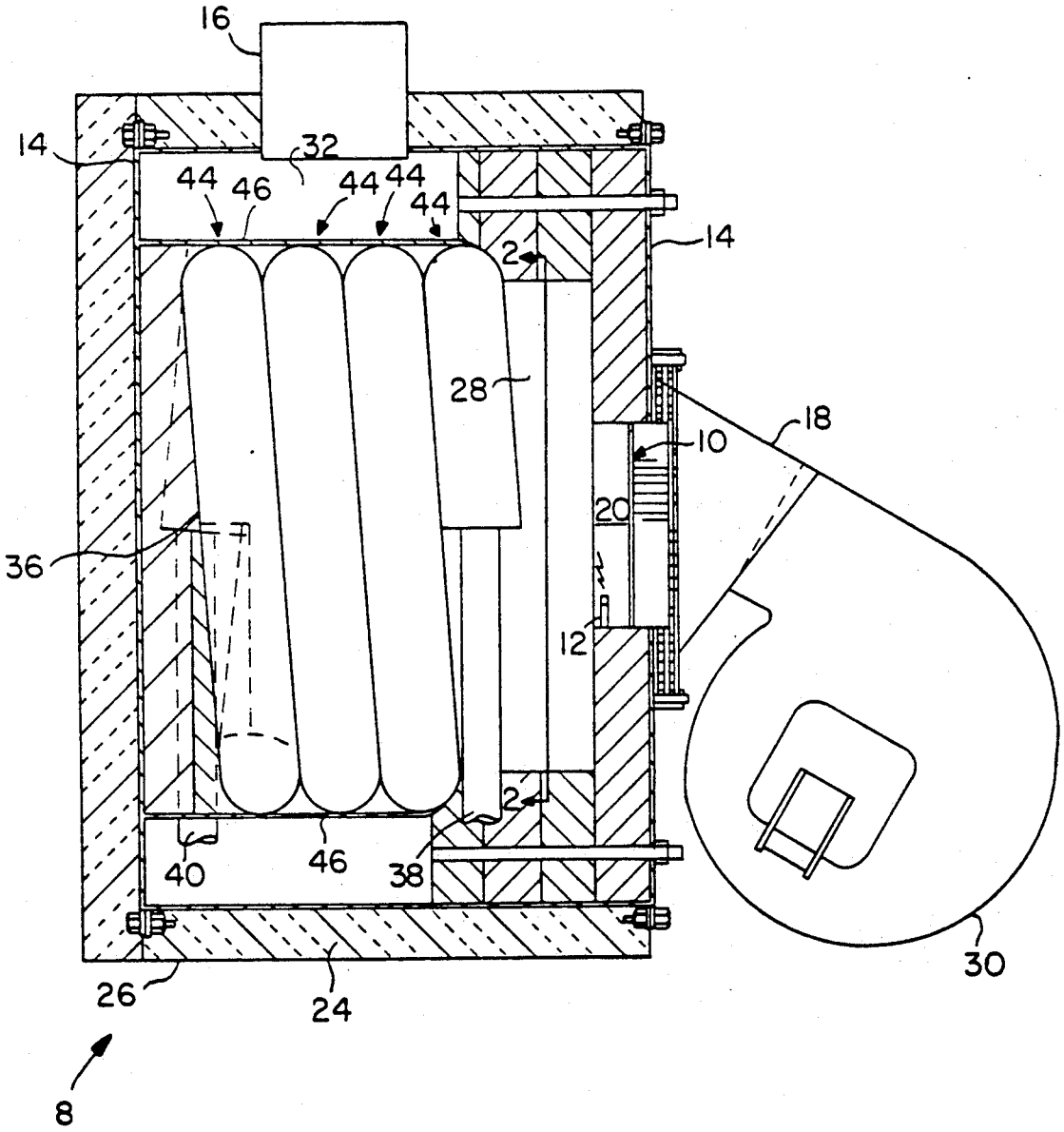
FIG. 1 is a side view, partly in section, of the heater of the present invention.

With reference to FIG. 1, a housing 14 of a heater 8 is constructed of a non-corrosive metal, such as stainless steel. The heater 8 also has fiberglass or other similar insulation 24 enveloped by a sheet metal skin 26. The insulation 24 serves the dual purpose of preventing heat loss from a heat exchange chamber 28 to increase efficiency, and of maintaining the skin 26 and external environment at a reasonable temperature. The sheet metal skin 26 protects the insulation 24 from wear and tear.

External to the main portion of the heater 8 and attached thereto is a blower 30 for forcing mixed gas and air through the heater 8. The gases enter the blower 30 from a pre-mix gas valve (not shown) which mixes the gases in a fixed proportion regardless of firing rate. The gases are then directed through an inlet manifold 18 to a burner plate 10. The gases are ignited by a hot surface ignitor 12, preferably a silicon carbide ignitor which also acts as a flame sensor. The burner plate 10 acts as a flame holder, keeping the flame stable, and is composed of perforated ceramic tile material to withstand the high temperatures generated in a combustion chamber 20. Such ceramic tile burners are well known in the art.

Combustion products leave the combustion chamber 20 and pass into the heat exchange chamber 28. After heat exchange with a wound tube 36, the cooled combustion gases exit the heat exchange chamber 28 through metering slots 44 in a baffle 46 covering an outer perimeter of the tube 36 (FIGS. 1 and 4) and flow to an outer housing chamber 32. The gases then flow to a flue 16 which passes from an outer housing chamber 32 through the housing 14, insulation 24, and skin 26 into the environment. The slots 44 in the baffle 46 are preferably positioned in line with the apices or high points of finned surfaces (defined herein below) of the heat exchange tube 36, so as to ensure that hot combustion gases pass over the tube 36 prior to exiting from the heat exchange chamber 28.

Figure 2:
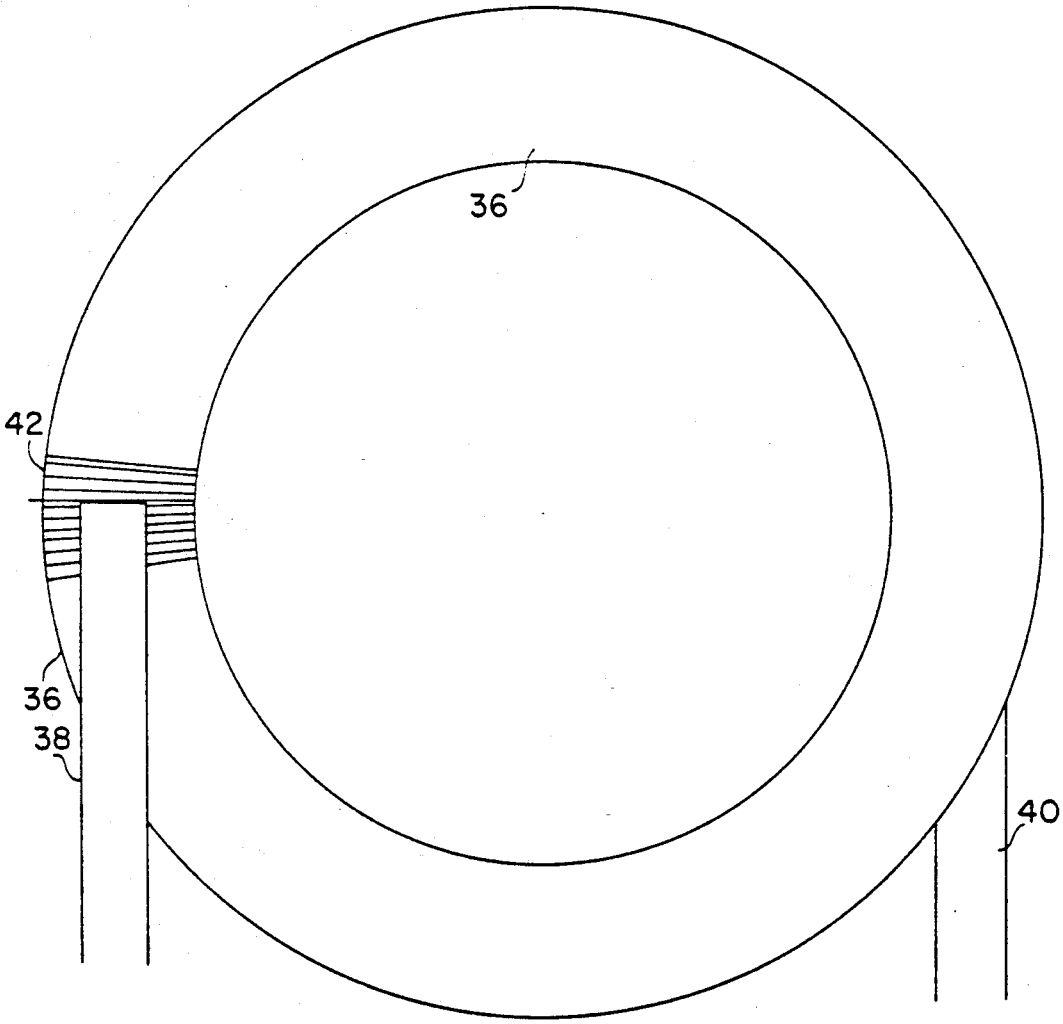
FIG. 2 is a front cross-sectional view, in partial detail, of the heater taken along the line 2—2 in FIG. 1, showing the finned tube.

Heat exchange takes place at the surface of the wound tube 36 which is formed of a heat-conductive material, preferably copper, which may be wound in a spiral fashion. Water flows through the tube 36 in a counterclockwise direction (as viewed in FIG. 2), entering the tube 36, as from a heating system (not shown) at a water inlet 40 at the end of the heat exchange chamber 28 remote from the combustion chamber 20 and exiting to the heating system through a water outlet 38 at a lower corner near the combustion chamber 20.

Figure 3:
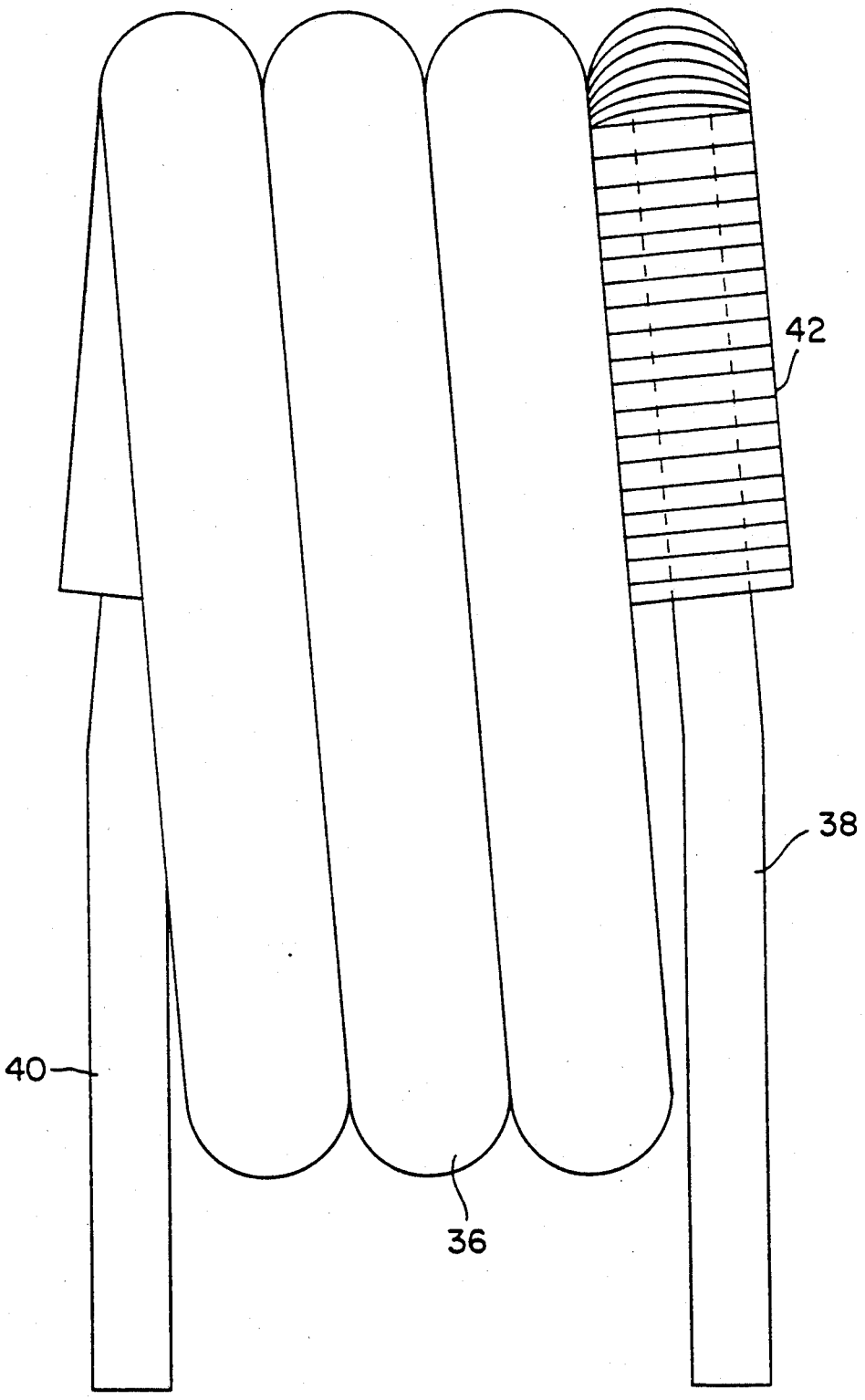
FIG. 3 is a side view, in partial detail, of the finned tube of FIG. 2.

As noted above, and as shown in FIGS. 2 and 3, the heat exchange tube 36 has a finned outer surface comprising disk-like fins 42 which preferably are integral with the tube, which avoids any risk of their separation from the tube (as might occur were the fins brazed or otherwise fastened to the tube). The fins 42 improve heat transfer by increasing the surface area used for heat exchange around the tube 36. The outlet and inlet portions 38, 40 of the tube have no fins.

Figure 4:
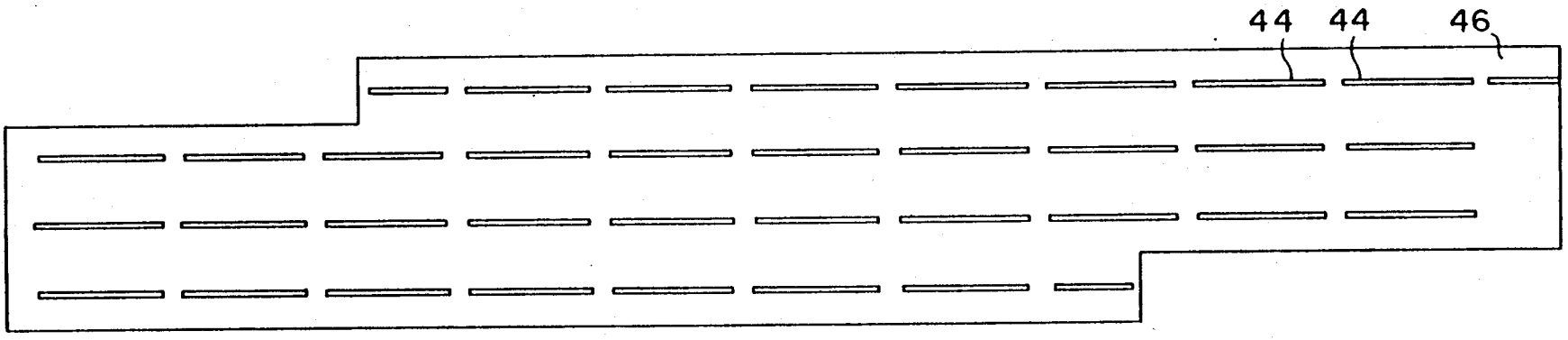
FIG. 4 is a top view of the slotted baffle of the heater in a flat configuration.

FIG. 4 shows the baffle 46 in a flat configuration, and the metering slots 44. In use, the baffle 46 is wrapped around the finned tube 36 (FIG. 1) to form an enveloping jacket in order to improve contact between the gas and the finned tubing in the chamber 28. The baffle 46 keeps the hot combustion gas in proximity with the tube 36 and helps to insure uniform distribution of gases to all portions of the tube. Because of its initial flat construction, the baffle 46 is well-suited to the manufacture and assembly of the heater 8 of the present invention.

Figure 5:
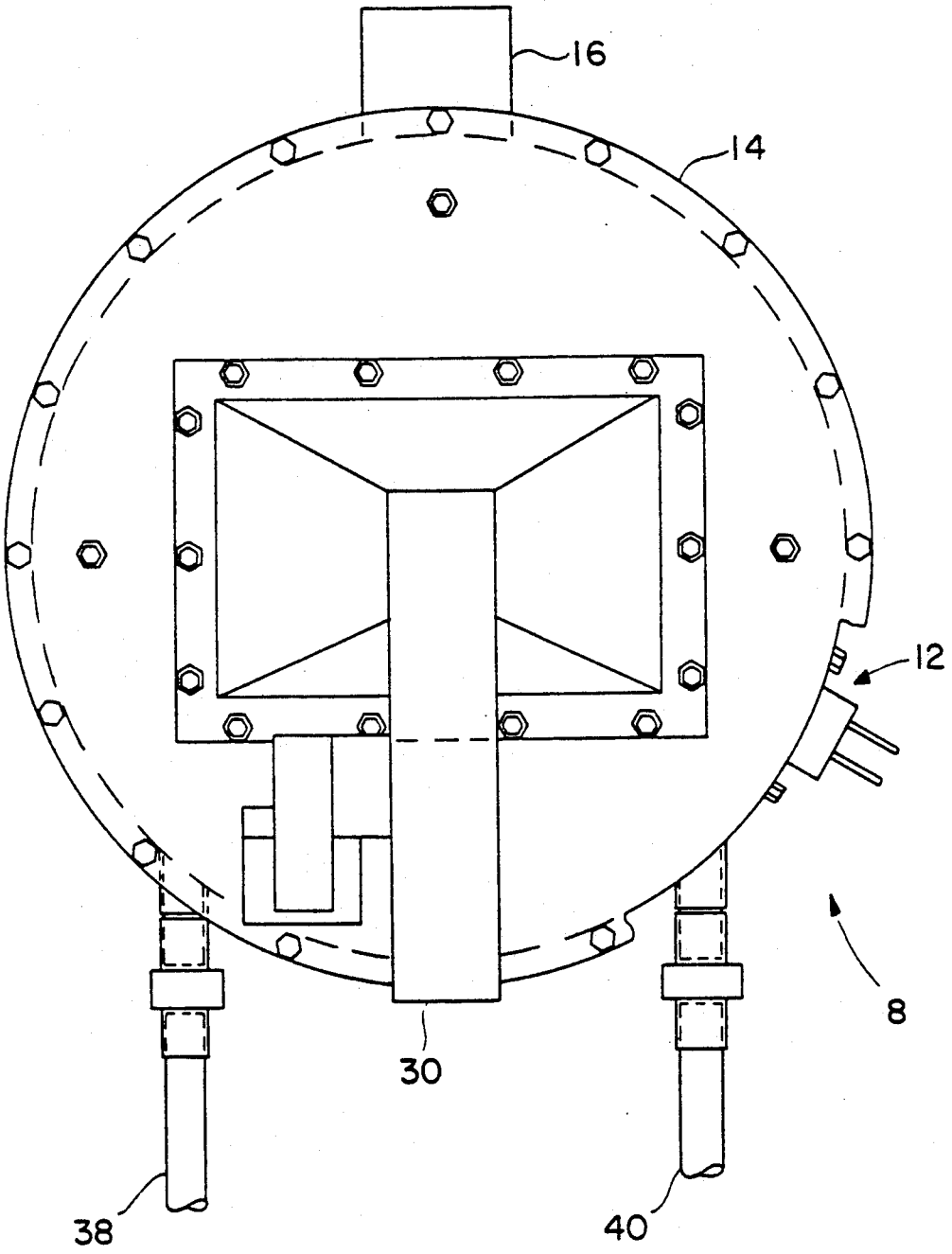
FIG. 5 is a front view of the heater of FIG. 1.

FIG. 5 is a front view of one important embodiment of the present invention showing the front portion of the housing 14 with a circular cross-section. In overall dimension, the embodiment of FIG. 5 may be 16" in diameter and 18" long. The housing is of a configuration complementary to the external configuration of the tube 36. As such, the housing may be of circular, elliptical, or other configuration. The elliptical shape allows a smaller unit profile than does the circular configuration.

The heater of the present invention has been lab tested with firing rates of 26 BTUH to 125 BTUH, and has developed efficiencies of 83-86% at fluid outlet temperatures of 230° F. Although the present invention is capable of being adapted for use in an integrated heating system such as is common in the prior art, such an integrated heating system forms no part of the present invention. It is contemplated that the present invention will be very useful as a heat source in conjunction with many types of gas fired equipment.

The above description is not intended to limit the invention. The scope of the invention should be construed in accordance with the accompanying claims, having due regard for changes that are obvious to those skilled in the art.

We claim:

1. A hydronic heater comprising:

a housing, said housing defining in part a heat exchange chamber, a wound heat transfer tube within said heat exchange chamber, said tube having an inlet and an outlet for conducting fluid through said heat exchange chamber, said wound heat transfer tube comprising a single tube having fins integral with the external surface thereof and extending therefrom, a baffle having therein gas-metering orifice means, said baffle being wrapped around said heat transfer tube and defining in part said heat exchange chamber, said baffle and said housing further defining an outer housing chamber concentrically therebetween, said gas-metering orifice means comprising a plurality of rows of slots, each of said rows being positioned adjacent the closest point of approach of said fins to said baffle, and means for producing combustion gases and for directing said combustion gases through said heat exchange chamber into contact with said tube and out through said gas metering orifice means to said outer housing chamber.

2. The heater of claim 1 wherein said housing has a circular cross-section and said outer housing chamber is of an annular configuration.

3. The heater of claim 1 wherein said means for producing and directing combustion gases include a burner and a blower for directing a mixture of air and fuel gas to said burner and forcing combustion gases through said heat exchange chamber, said baffle and said outer housing chamber; said heater further comprising a flue in fluid communication with said outer housing chamber for allowing combustion gases to exit said heater.

* * * * *